US006808083B2

(12) United States Patent
Roekens et al.

(10) Patent No.: US 6,808,083 B2
(45) Date of Patent: Oct. 26, 2004

(54) HOT AND COLD VENDING APPARATUS

(75) Inventors: Jurgen Roekens, Steenokkerzeel (BE); Willy Van Esch, Grez-Doiceau (BE); Bart Carpentier, Zoersel (BE)

(73) Assignee: The Coca-Cola Company, Atlanta, GA (US)

( * ) Notice: Subject to any disclaimer, the term of this patent is extended or adjusted under 35 U.S.C. 154(b) by 124 days.

(21) Appl. No.: 10/159,521

(22) Filed: May 31, 2002

(65) Prior Publication Data

US 2003/0222093 A1 Dec. 4, 2003

(51) Int. Cl.[7] ..... A24F 27/14
(52) U.S. Cl. ..... 221/150 HC
(58) Field of Search ..... 321/150 R, 150 HC, 321/150 A, 92, 123, 129, 121; 219/679, 753; 99/357

(56) References Cited

U.S. PATENT DOCUMENTS

| | | | | |
|---|---|---|---|---|
| 3,333,666 A | | 8/1967 | Murray et al. | 194/10 |
| 3,386,550 A | | 6/1968 | Murray et al. | 194/10 |
| 3,653,541 A | * | 4/1972 | Crum | 221/150 HC |
| 3,866,795 A | | 2/1975 | Urano | 221/150 HC |
| 4,004,712 A | | 1/1977 | Pond | 221/150 |
| 4,513,879 A | * | 4/1985 | Reiss | 221/150 HC |
| 4,771,913 A | | 9/1988 | Johndrow et al. | 221/150 |
| 4,783,582 A | | 11/1988 | Wada et al. | 219/10.55 |
| 4,784,292 A | | 11/1988 | Johndrow et al. | 221/101 |
| 5,147,068 A | | 9/1992 | Wright | 221/9 |
| 5,147,994 A | | 9/1992 | Smith et al. | 219/10.55 |
| 5,209,373 A | | 5/1993 | Gondek et al. | 221/150 |
| 5,564,594 A | | 10/1996 | Monfredo | 221/150 A |
| 5,566,856 A | | 10/1996 | Fallen et al. | 221/150 HC |
| 5,589,093 A | | 12/1996 | Chen | 219/679 |
| 5,598,947 A | | 2/1997 | Smith | 221/150 |
| 5,878,910 A | | 3/1999 | Gibernau et al. | 221/150 |
| 6,098,524 A | | 8/2000 | Reese | 99/280 |
| 6,155,071 A | | 12/2000 | Koyanagi | 62/457.2 |

FOREIGN PATENT DOCUMENTS

| | | |
|---|---|---|
| CA | 2 032 588 | 7/1991 |
| EP | 0 986 983 A1 | 3/2000 |
| EP | 0 011 082 A2 | 6/2000 |
| EP | 1 011 297 A2 | 6/2000 |
| GB | 862658 | 3/1961 |
| GB | 1 515 605 | 6/1978 |

(List continued on next page.)

OTHER PUBLICATIONS

VENDO®—Parts Manual, Vendo Italy S.p.A., Casella Postale 9 I.15033 Casale Monf. (AL) Italy; Complete Manual.

*Primary Examiner*—Kenneth Noland
(74) *Attorney, Agent, or Firm*—Sutherland Asbill & Brennan LLP

(57) ABSTRACT

A vending machine for dispensing a first number of products and a second number of products. The vending machine may include a product compartment. The product compartment may include a first column with the first products and a second column with the second products. A dispensing path may be positioned about the product compartment so as to dispense the first products without heating. A heating device may be positioned adjacent to the product compartment for heating the second products. A positioning device may be positioned about the second column to maneuver the second products to the heating device and the dispensing path so as to dispense the second products as heated.

20 Claims, 6 Drawing Sheets

FOREIGN PATENT DOCUMENTS

| | | | |
|---|---|---|---|
| GB | 2 278 839 | | 12/1994 |
| JP | 4217758 | | 8/1992 |
| JP | 06-162343 | | 6/1994 |
| JP | 06-243337 | | 9/1994 |
| JP | 06-325258 | | 11/1994 |
| JP | 7334753 | | 12/1995 |
| JP | 8221654 | | 8/1996 |
| JP | 08-2211653 | | 8/1996 |
| JP | 8293062 | | 11/1996 |
| JP | 9017569 | | 1/1997 |
| JP | 09-091531 | | 4/1997 |
| JP | 9138883 | | 5/1997 |
| JP | 10079085 | | 3/1998 |
| JP | 10275273 | | 10/1998 |
| JP | 10283556 | | 10/1998 |
| JP | 10320623 | | 12/1998 |
| JP | 11161844 | | 6/1999 |
| JP | 11162628 | | 6/1999 |
| JP | 11328519 | * | 11/1999 |
| JP | 20000347 | | 3/2000 |
| JP | 2000149130 | | 5/2000 |
| JP | 2000163642 | | 6/2000 |
| JP | 2000182134 | | 6/2000 |
| WO | WO 92/12502 | * | 7/1992 |

* cited by examiner

HOT AND COLD VENDING APPARATUS

TECHNICAL FIELD

The present invention relates to vending machines and more particularly relates to vending machines that dispense both hot and cold products.

BACKGROUND OF THE INVENTION

Vending machines traditionally dispense either a heated product or a cold product, but not both. This is generally due to the expense involved in having both a heated space and a chilled space. Although such vending machines do exist, known machines require insulation between the respective compartments. The use of a heating device, a chilling device, and extra insulation, however, adds to the cost of the vending machine as a whole and limits the number of products that may be stored therein.

Another drawback with heated vending machines is that the products therein generally have a relatively short shelf life. For example, chilled products, such as chilled beverages, may have a "shelf life" in the vending machine of several months. A heated product, such as a heated beverage, however, only may have a shelf life of several days or weeks. The vending machine may need to be restocked often. Given that the sale of certain products may be seasonal, it may be difficult to keep an adequate stock of fresh products in the machine.

There is a desire, therefore, for a vending machine that can adequately store and vend both hot and cold products. Such a vending machine preferably should be easy to use and be reasonable in terms of the cost of use and the cost of manufacturing.

SUMMARY OF THE INVENTION

The present invention thus provides a vending machine for dispensing a first number of products and a second number of products. The vending machine may include a product compartment. The product compartment may include a first column with the first products and a second column with the second products. A dispensing path may be positioned about the product compartment so as to dispense the first products without heating. A heating device may be positioned adjacent to the product compartment for heating the second products. A positioning device may be positioned about the second column to maneuver the second products to the heating device and the dispensing path so as to dispense the second products as heated.

Specific embodiments may include a dispensing path with one or more internal chutes. The internal chutes may be positioned under the first column of the product compartment. The dispensing path may include one or more external chutes. The internal chutes may be in communication with the external chutes. The product compartment may include a number of first columns and a number of second columns.

The positioning device may include a conveyor positioned under the second column of the product compartment. The positioning device may include a gully positioned adjacent to the conveyor. The gully may include a first end and a second end. The positioning device may include a pushing device. The pushing device may be positioned for pushing one of the second products from the first end to the second end of the gully. The pushing device may include a lever mounted on a rotating arm. The heating device may be positioned adjacent to the second end of the gully such that the pushing device may push one of the second products into the heating device.

The heating device may include a product heating compartment. The positioning device may include a rotating door. The rotating door may be positioned about the product heating compartment. The rotating door may include a product support positioned thereon. The dispensing path may include one or more internal chutes positioned adjacent to the heating device. The internal chutes may include a rotating plate. The rotating plate may be positioned adjacent to the rotating door such that the rotating door may maneuver one of the second products from the product heating chamber to the internal chutes via the rotating plate.

The present invention may further provide a vending machine for providing a number of products. The vending machine may include a product compartment for storing the products. The vending machine may include a microwave device for heating some of the products. The vending machine also may include a dispensing chute and a positioning device for transporting some of the products from the product compartment, to the microwave device, and to the dispensing chute. The positioning device may include a rotating member so as to rotate some of the products into the microwave device and to the dispensing chute.

The present invention may further provide a vending machine for dispensing a first number of products and a second number of products via one or more external chutes. The vending machine may include a product compartment, a heating device positioned about the product compartment, and a dispensing path positioned about the product compartment. The dispensing path may direct the first number of products into the heating device and into one of the external chutes. The dispensing path also may direct the second number of products into one of the external chutes. The vending machine further may include a refrigeration device in communication with the product compartment for chilling the products. The heating device may include a microwave device.

The present invention may further provide a vending machine for dispensing a first number of products and a second number of products. The vending machine may include a product compartment for chilling the products. The product compartment may include a first number of columns for the first products and a second number of columns for the second products. The vending machine may include a dispensing chute positioned under the first columns such that the first products may fall therein. The vending machine also may include a heating device positioned under the second columns so as to heat the second products and a positioning device to maneuver the second products into the heating device and into the dispensing chute.

A method of the present invention may provide for vending a first number of products and a second number of products from a vending machine. The method may include the steps of chilling the products. In response to a request for a cold product, the method may provide for dispensing one of the first products. In response to a request for a hot product, the method may provide for maneuvering one of the second products into a heating device and dispensing the second product.

Other features of the present invention will become apparent upon review of the following detailed description of the embodiments when taken in conjunction with the drawings and the appended claims.

DETAILED DESCRIPTION

Figure 1:
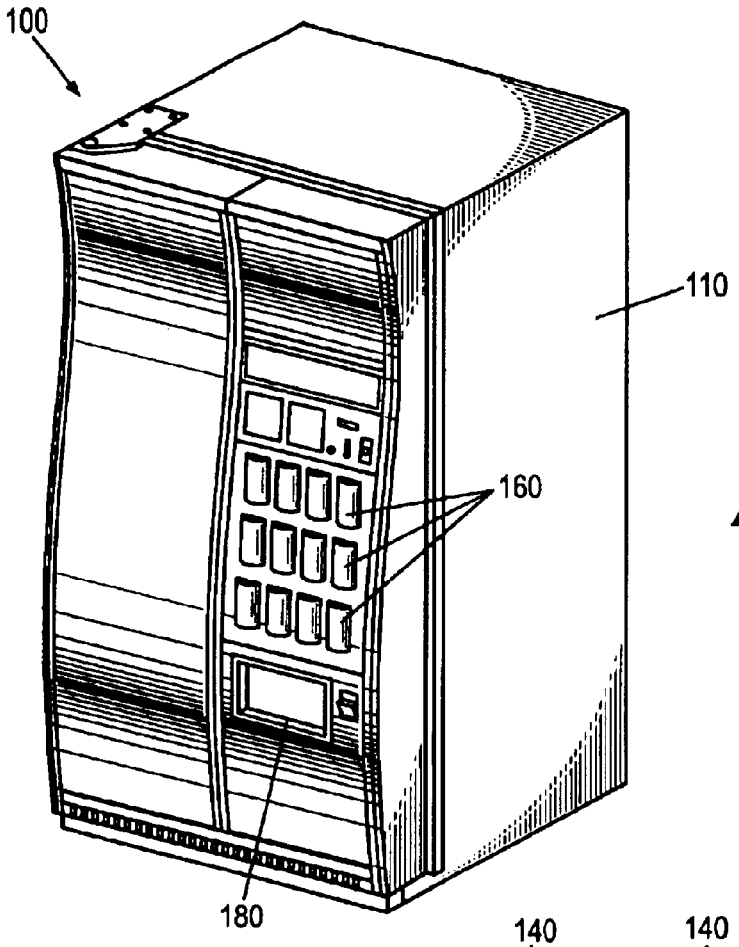
FIG. 1 is a perspective view of a vending machine for use with the present invention.
Figure 2:
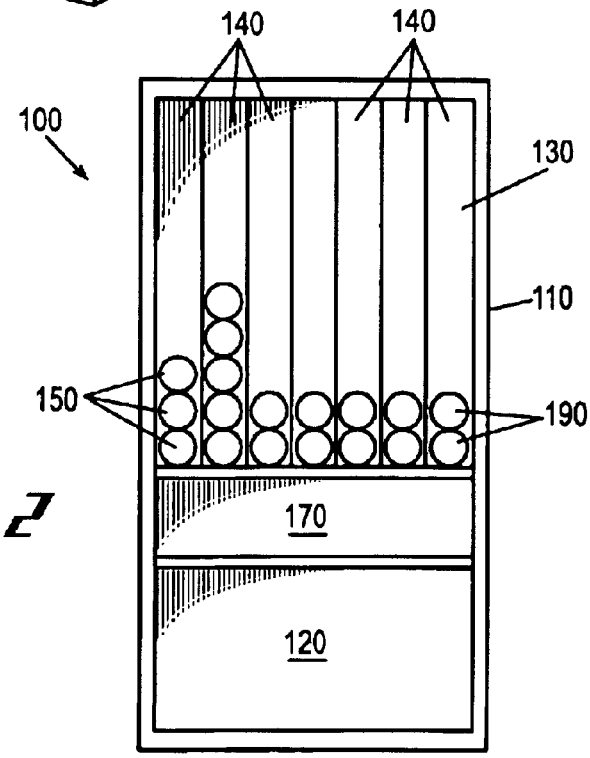
FIG. 2 is plan view of the interior of the vending machine of FIG. 1.
Figure 3:
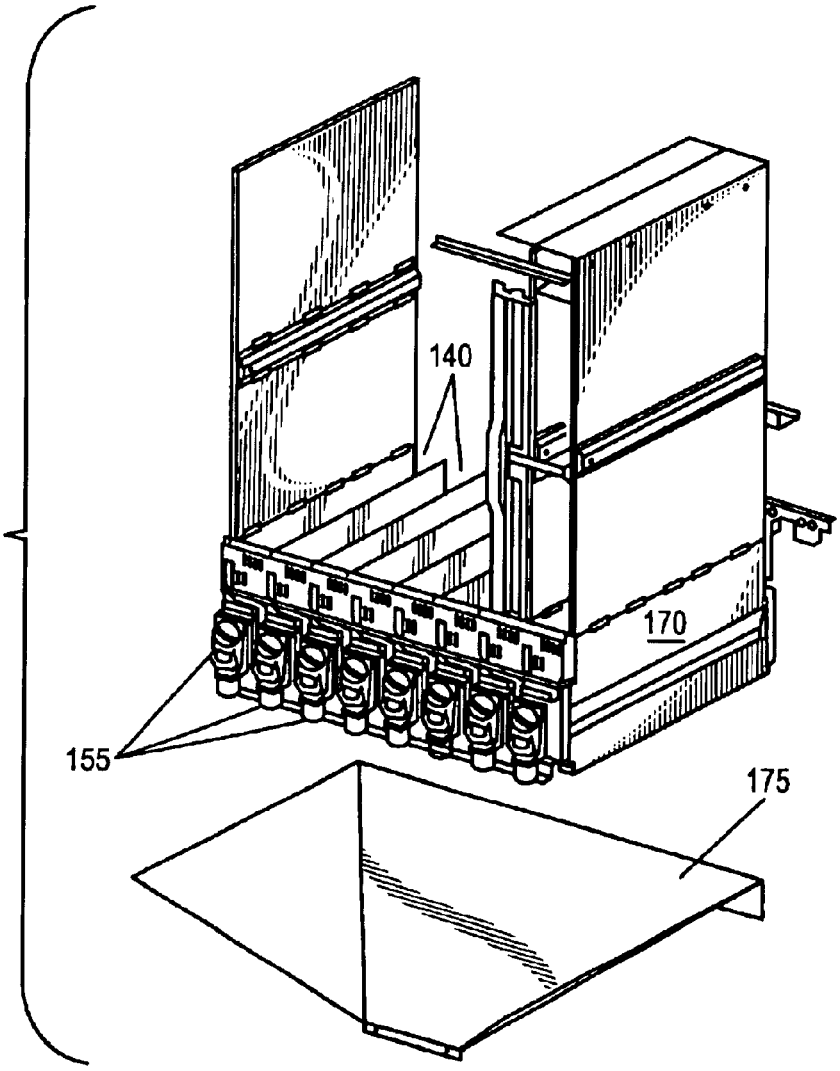
Fig. 3 (PRIOR ART)
FIG. 3 is a perspective view of a prior art vending area as used in the vending machine of FIG. 1.

Referring now to the drawings, in which like numerals refer to like parts throughout the several views, FIGS. 1–3 show a vending machine 100 suitable for use with the present invention. The vending machine 100 may be largely of conventional design. The vending machine may have an outer shell 110. The outer shell 110 may be insulated. Positioned within the outer shell 110, or in communication therewith, may be a refrigeration deck 120. The refrigeration deck 120 may provide cooling to the vending machine 100 in a conventional manner. The refrigeration deck 120 may include a Rankine cycle device, a Stirling cycle cooler, a transcritical carbon dioxide cycle device, or any other type of heat transfer devices.

Positioned within the outer shell 110 of the vending machine 100 and adjacent to or in communication with the refrigeration deck 120 may be a refrigerated area 130. The refrigerated area 130 may have any size or dimension. The refrigerated area 130 may include a number of product columns 140. Any number of product columns 140 may be used. Each product column 140 may store a plurality of products 150 therein. Each product column 140 may include a triggering device 155 positioned thereon. The triggering device 155 may be of conventional design. The triggering device 155 may be in communication with one or more selection buttons 160 positioned on the outer shell 110 of the vending machine 100.

Positioned within the outer shell 110 of the vending machine 100 and adjacent to the product columns 140 within the refrigerated area 130 may be a vending area 170. The vending area 170 may have any size or dimension. As is shown in FIG. 3, the vending area 170 may include an internal chute 175 positioned therein directly underneath the product columns 140. The internal chute 175 may be in communication with one or more external chutes 180 positioned within the outer frame 110. Once a consumer makes a selection via one of the selection buttons 160, the triggering device 155 may allow one of the products 150 in the product columns 140 to fall under the force of gravity or to be otherwise transferred into the internal chute 175 and out of the vending machine 100 via one of the external chutes 180.

The products 150 may be any type of product that may be stored or served as chilled. Alternatively, the products 150 also may be stored at room temperature or any desired temperature. In this example, a beverage container 190 may be used. The beverage container 190 may be a bottle, a can, a box, a pouch, or any other type of container. The beverage container 190 may contain any type of beverage such as carbonated soft drinks, coffees, teas, juices, waters, sports drinks, milk, and the like. The product 150 may be desired either hot or cold, e.g., coffee. The product 150 also may be only cold when served and consumed, e.g., a soft drink. Likewise, any type of food product also may be used herein.

Figure 4:
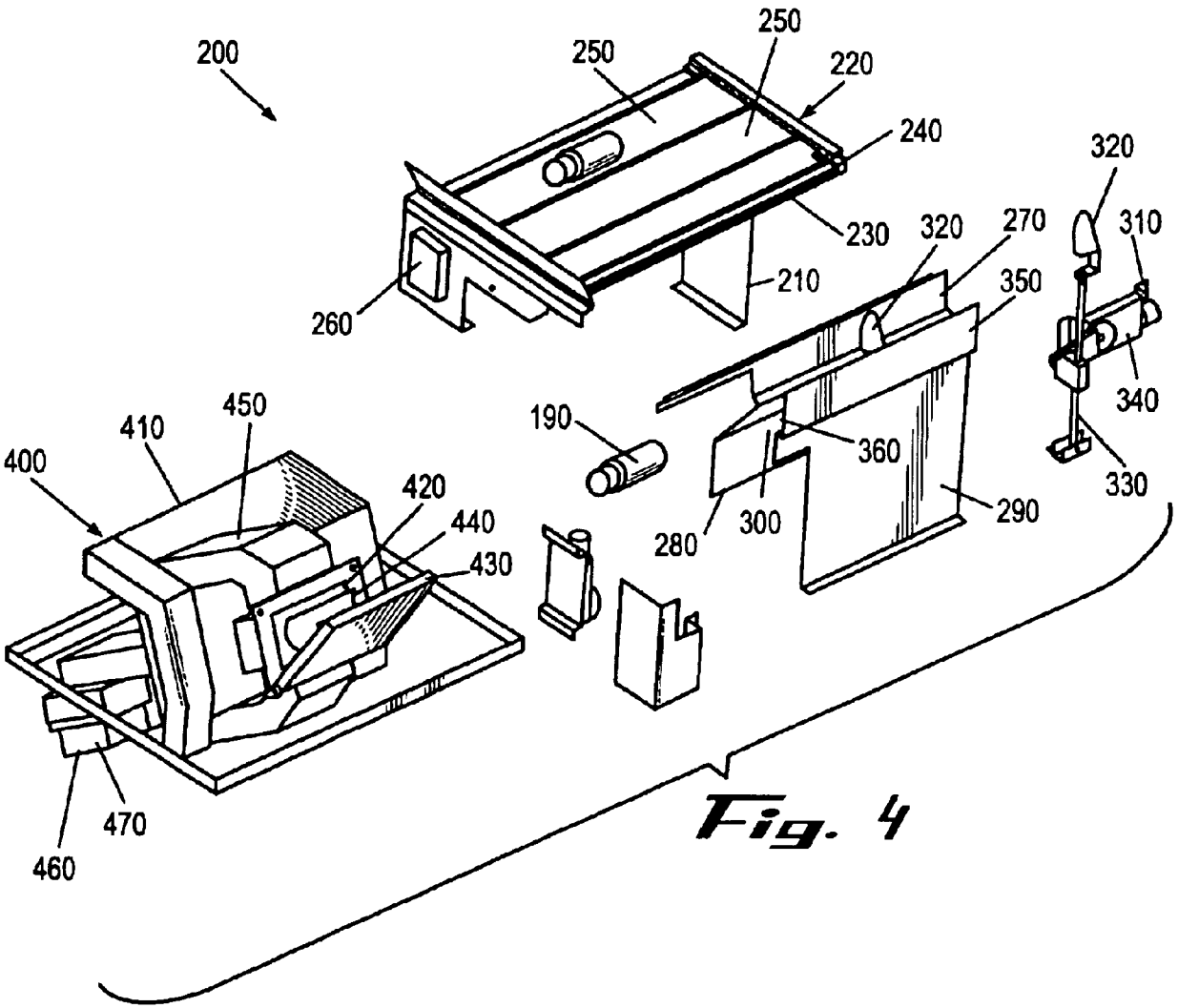
FIG. 4 is an exploded view of a dispensing kit of the present invention.
Figure 5:
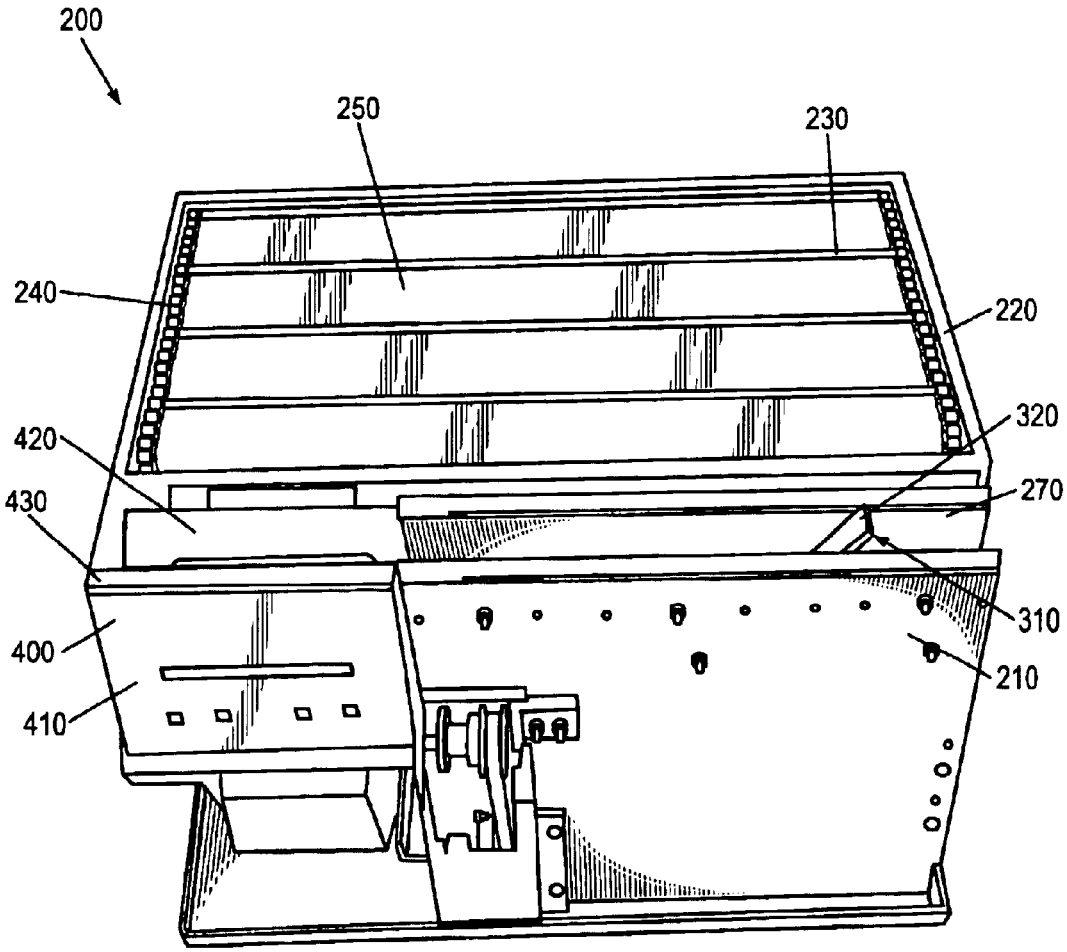
FIG. 5 is a top perspective view of the dispensing kit of FIG. 4.
Figure 6:
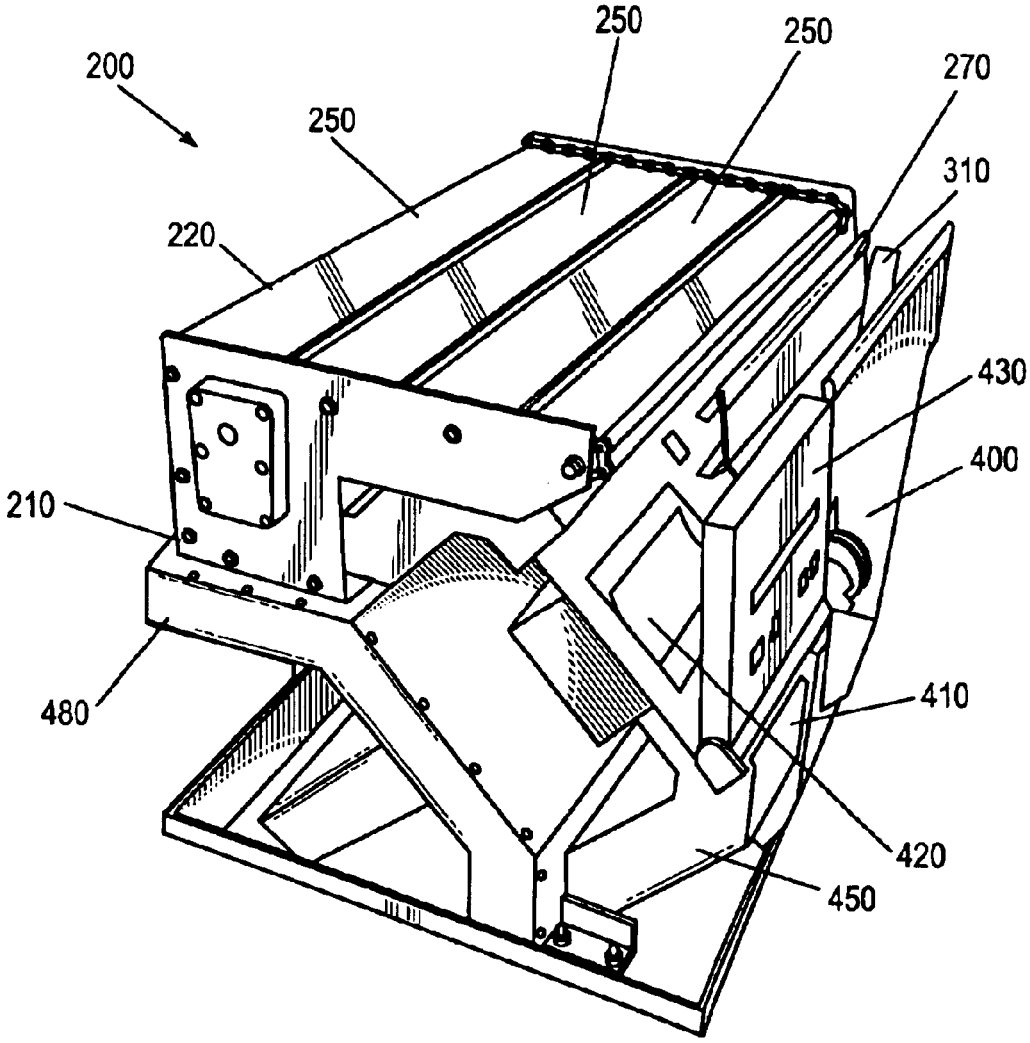
FIG. 6 is a side perspective view of the dispensing kit of FIG. 4.

FIGS. 4–6 show a dispensing kit 200 that may be installed within the vending area 170 of the vending machine 100. The dispensing kit 200 allows the products 150 to pass from the product columns 140 to the one or more external chutes 180. The dispensing kit 200 may be a retrofit for an existing vending machine 100 or the dispensing kit 200 may be original equipment therein. In the case of a retrofit, the internal chute 175 probably will be removed in whole or in part from the vending area 170 such that the dispensing kit 200 may be positioned therein.

The dispensing kit 200 may include a frame 210. The frame 210 may be made out of stainless steel or other types of rigid materials. The frame 210 may be fixedly or removably attached within the outer shell 110 of the vending machine 100 or otherwise positioned therein.

Positioned on top of the frame 210 may be a conveyor belt system 220. The conveyor belt system 220 may be of conventional design. The conveyor belt system 220 may include a number of cylindrical tubes 230 mounted on a chain 240. A number of plates 250 may be positioned on the tubes 230. The components 230, 240, 250 of the conveyor belt system 220 may be made out of stainless steel, or other types of materials. Although rigid materials are described herein, rubber, textiles, or any other type of materials also may be used within the conveyor belt system 220. The components 230, 240, 250 may be driven by a conveyor drive 260. The conveyor drive 260 may be a conventional electric motor or other types of conventional drive devices. The conveyor drive 260 may drive the chain 240 so as to move the tubes 230 and the plates 250. The conveyor belt 220 may be positioned underneath one or more of the product columns 140. In this example, the conveyor belt 220 is positioned under four (4) of the product columns 140.

Alternatively, an incline plate or other structure may be used instead of the conveyor belt system 220. The incline plate may allow the products 150 to fall thereon and then roll or move down the plate under the force of gravity.

The frame 210 of the dispensing kit 200 also may include a gully 270 positioned adjacent to the conveyor belt system 220. The gully 270 may be sized so as to permit one of the products 150 to fall therein from the conveyor belt system 220 or otherwise. The gully 220 may have any desired size or shape. The gully 270 may have a first member 280 defined apart from a second member 290. The members 280, 290 may make a broken "U" shape with an aperture 300 defined therebetween. The members 280, 290 may be made out of stainless steel or other types of rigid materials.

Positioned adjacent to the gully 270 may be a pushing device 310. The pushing device 310 may be positioned so as to operate within the aperture 300 of the gully 270. The pushing device 310 may include a lever 320. The lever 320 may be made out of stainless steel or other types of substantially rigid materials. The lever 320 may have one end made out of plastic or the end may be plastic coated. Teflon or similar types of materials may be used to reduce friction with the products 150. The lever 320 may be mounted on a rotating arm 330 for movement therewith. The rotating arm 330 may be driven by a lever drive 340. The lever drive 340 may be a conventional electrical motor or similar types of drive devices. The lever 320 may maneuver along the aperture 300 so as to push the product 150 within the gully 270 from one end to another. Specifically, the lever 320 may extend from a first side 350 of the gully 270 to a second side 360 and then return under the control of the lever drive 340.

Although rotational movement has been described herein, the pushing device 310 may take any convenient form so as to move the product 150 from the first side 350 to the second side 360. For example, a piston driven device, a conveyor device or other types of drive means may be used. Likewise, an inclined gully, plate, or other type of structure may be used such that the product 150 moves under the force of gravity.

The dispensing device 200 may have a heating device 400 positioned adjacent to the second side 360 of the gully 270. In this example, the heating device 400 may be a microwave type device 410 as is shown. Any type of conventional heating device, however, also may be used herein. For example, conventional convection, conduction, or similar types of heating devices may be used. The microwave device 410, however, is generally considered faster than other types of heating devices and may provide for more uniform heating.

Figure 7:
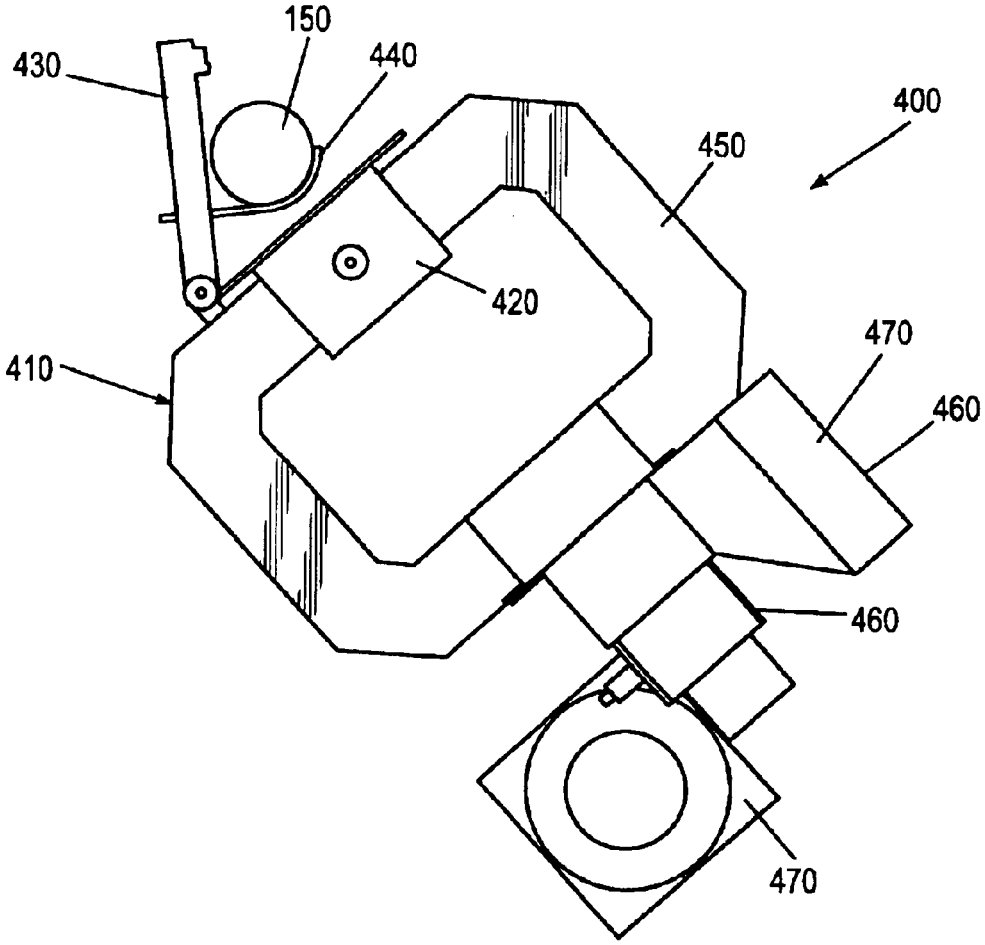
FIG. 7 is a side plan view of the heating system of the dispensing kit of FIG. 4.

As is shown in FIG. 7, the heating device 400 may include a product heating chamber 420. The product heating chamber 420 may be sized according to the particular product 150 intended for use therein. Then product heating chamber 420 may have any desired size or shape. The product heating chamber 420 may be made out of stainless steel or similar types of rigid and conductive materials. Alternatively, the product heating chamber 420 also may be made out of a thermoplastic and have an internal conductive coating. The coating may be made out of chrome or similar types of materials. A door 430 may enclose the product heating chamber 420. The door 430 also may be made out of stainless steel or similar types of rigid and conductive materials. Alternatively, the door 430 also may be made out of a thermoplastic and have an internal conductive coating. The coating may be made out of chrome or similar types of materials. The door 430 will largely prevent the transmission of microwaves or other forms of thermal energy out of the product heating chamber 420.

A bucket 440 may be attached to one side of the door 430. The bucket 440 may be substantially "U" or "J" shaped such that one of the products 150 may be held therein between the bucket 440 and the door 430. The shape of the bucket 440 may vary with the shape of the products 150 intended for use therein. When the door 430 is in its open position, the door 430 and the bucket 440 may align with the gully 270 such that the pushing device 310 may push one of the products 150 from the gully 270 into the bucket 440. The door 430 may be hinged and motorized such that the door 430 may rotate the bucket 440 and the product 150 into and out of the product heating chamber 420.

The heating device 400 may include a waveguide 450 in communication with the product heating chamber 420. The waveguide 450 may be made out of stainless steel or similar types of rigid and conductive materials. Alternatively, the waveguide 450 also may be made out of a thermoplastic and have an internal conductive coating. The coating may be made out of chrome or similar types of materials. In this example, the waveguide 450 may be largely rectangular with chamfered corners in shape.

The heating device 400 also may include one or more magnetron devices 460. The magnetron devices 460 may include a high voltage transformer. In this example, two (2) 1000 Watt magnetrons 460 may be used. A single 2000 Watt magnetron 460 also may be used. Any desired number of magnetrons 460 may be used. The heating device 400 may include a fan 470 or other type of air movement device for the purpose of cooling the magnetrons 460.

The heating device 400 may heat a beverage container 190 with about 200 milliliters of coffee or other type of beverage therein from about four (4) degrees Celsius to about 55 degrees Celsius in about 25 seconds. This assumes that the magnetrons 460 are operated at about fifteen (15) Amps. The heating time may be about 29 seconds if about 12.5 amps are used. The heating time may vary depending upon the desired temperature and the quantity of the product 150 being heated.

An insulation layer 480 may be positioned around or across the waveguide 450 so as to separate the magnetrons 460 and the refrigeration deck area 120 at ambient temperature or higher from the refrigerated area 130. The insulation layer 480 may include any type of insulating materials. The insulation layer 480 largely prevents ambient airflow into the refrigerated area 130.

Positioned adjacent to the heating device 400 may be a modified internal chute 500. The modified chute 500 may extend across one or more of the product columns 140 and may be positioned adjacent to the conveyor belt system 220. Products 150 from the product columns 140 positioned over the modified chute 500 may drop into the chute 500 in a manner similar to known devices. Alternatively, all of the products 150 may travel through the heating device 400, although the heating device 400 may not be turned on for products 150 that are desired to be served chilled or at room temperature.

Figure 8:
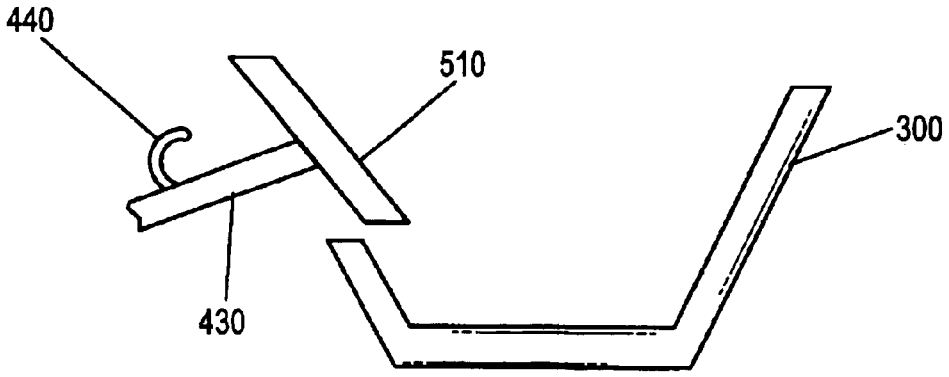
FIG. 8 is a side plan view of an internal chute for use with the dispensing kit of FIG. 4.

As is shown in FIG. 8, the modified chute 500 may include a plate 510. The plate 510 may be positioned immediately adjacent to the door 430 of the heating device 400. The plate 510 may be hinged such that rotation of the door 430 also may cause the plate 510 to rotate. As the door 430 rotates the product 150 out of the product heating chamber 420, the plate 510 opens a pathway into the modified chute 500. The product 150 may then roll out of the bucket 440 so as to be dispensed through the external chute 180. Although the plate 510 as rotated is described herein, other type of access means may be used. For example, the plate 510 may be omitted such that the product 150 in the door 430 may rotate and fall directly into the external chute.

In use, the vending machine 100 may be stocked with products 150 in a conventional manner. The products 150 may be stored in the product columns 140. The products 150 may remain chilled through the operation of the refrigeration deck 120. Alternatively, the products 150 may be stored at room temperature or otherwise.

The dispensing kit 200 may be inserted within the vending area 170 of the vending machine 100 after removing part or all of the internal chute 170. Alternatively, the dispensing kit 200 may be originally installed within the outer shell 110 of the vending machine 100.

A consumer may select any of the products 150 within the vending machine 100 via the selection buttons 160. The consumer also may select whether the product 150 should be served heated or chilled. The selection buttons 160 may indicate the name or the trademark for the product 150 and whether the product 150 is to be served heated or chilled. Alternatively, one set of selection buttons 160 may indicate the name or the trademark for the product 150 and another set of selection buttons 160 may indicate whether the product 150 is to be served heated or chilled.

If the consumer selects a chilled product 150, the product 150 may fall out of the product column 140 directly into the modified chute 500 and out of the vending machine 100 through the external chute 180. If a consumer selects a product 150 that may be served heated or chilled, the consumer may be prompted to select such via the selection buttons 160. One of the products 150 from the product columns 140 over the conveyor belt 220 may drop on the conveyor belt 220 via the triggering device 155. The conveyor belt 220 may then transport the product 150 such that it falls into the gully 270. Alternatively if the incline plate or a similar structure is used, the product 150 may roll or otherwise travel under the force of gravity into the gully 270. The pushing device 310 may then push the product 150 along the gully 270 into the bucket 440 of the door 430 of the product heating chamber 420. Once the product 150 is positioned within the bucket 440, the door 430 may rotate so as to close the product heating chamber 420 with the product 150 therein. If the product 150 is to be heated, the magnetrons 460 of the heating device 400 may then start emitting waves through the waveguide 450 into the product heating chamber 420. The emitted waves are concentrated within the product heating chamber 420 so as to transfer energy into the product 150 and hence heat the product 150.

Once the product 150 is properly heated and the magnetrons 460 are turned off, the door 430 of the heating device 400 may open and rotate into contact with the plate 510 of the modified chute 500. The door 430 will continue to rotate until the product 150 rolls out of the bucket 440 and into the modified chute 500. The product 150 then may exit the vending machine 100 via the external chute 180.

If the consumer desires a chilled beverage 150, however, the magnetrons 460 are not activated. Rather, the product 150 simply travels through the dispensing kit 200 and the heating device 400 and is expelled in a chilled fashion. Alternatively, the conveyor belt 220 may extend under substantially all of the product columns 140. As such, each of the products 150 may travel through the dispensing kit 200 and the heating device 400 as described above.

The operations and interaction of the vending machine 100 and the dispensing kit 200, as well as the individual components thereof, may be controlled, monitored, and set via a conventional microprocessor or a similar type of computing device. The programming of such a device is considered to be within the ability of one of ordinary skill in the art.

It should be apparent that the foregoing relates only to the preferred embodiments of the present invention and that numerous changes and modifications may be made herein without departing from the spirit and scope of the invention as defined by the following claims and the equivalents thereof.

We claim:

1. A vending machine for dispensing a first plurality of products and a second plurality of products, comprising:

a product compartment;

said product compartment comprising a first column with the first plurality of products and a second column with the second plurality of products;

a dispensing path positioned about said product compartment so as to dispense the first plurality of products without heating;

a heating device positioned adjacent to said product compartment for heating the second plurality of products; and a positioning device positioned about said second column to maneuver the second plurality of products to said heating device and said dispensing path so as to dispense the second plurality of products as heated.

2. The vending machine of claim 1, wherein said dispensing path comprises one or more internal chutes.

3. The vending machine of claim 2, wherein said one or more internal chutes are positioned under said fist column of said product compartment.

4. The vending machine of claim 1, wherein said positioning device comprises a conveyor positioned under said second column of said product compartment.

5. The vending machine of claim 4, wherein said positioning device comprises a gully positioned adjacent to said conveyor.

6. The vending machine of claim 5, wherein said gully comprises a first end and a second end.

7. The vending machine of claim 6, wherein said positioning device comprises a pushing device, said pushing device positioned for pushing one of the second plurality of products from said first end to said second end of said gully.

8. The vending machine of said claim 7, wherein pushing device comprises a lever mounted on a rotating arm.

9. The vending machine of claim 7, wherein said heating device in positioned adjacent to said second end of said gully such that said pushing device may push one of the plurality of second products into said heating device.

10. The vending machine of claim 1, wherein said heating device comprises a product heating compartment.

11. The vending machine of claim 10, wherein said positioning device comprises a rotating door, said rotating door positioned about said product heating compartment.

12. The vending machine of claim 11, wherein said rotating door comprises a product support positioned thereon.

13. The vending machine of claim 12, wherein said dispensing path comprises one or more internal chutes positioned adjacent to said heating device.

14. The vending machine of claim 13, wherein said one or more internal chutes comprise a rotating plate, said rotating plate positioned adjacent to said rotating door such that said rotating door may maneuver one of the second plurality of products from said product heating chamber to said one or more internal chutes via said rotating plate.

15. A vending machine for dispensing a first plurality of products and a second plurality of products, comprising:

a product compartment for chilling the first plurality of products and the second plurality of products;

said product compartment comprising a first plurality of columns for the first plurality of products and a second plurality of columns for the second plurality of products;

a dispensing chute positioned under the first plurality of columns such that the first plurality of products may fall into said dispensing chute;

a heating device positioned under the second plurality of columns so ma to heat the second plurality of products; and a positioning device to maneuver the second plurality of products into said heating device and into said dispensing chute.

16. A method for vending a first plurality of products and a second plurality of products from a vending machine, comprising:

chilling said first plurality of products and said second plurality of products;

in response to a request for a cold product) dispensing one of said first plurality of products; and in response to a request for a hot product:

pushing one of said second plurality of products into a heating device, and dispensing one of said second plurality of products.

17. A vending machine for dispensing a first plurality of products and a second plurality of products, comprising:

a product compartment;

said product compartment comprising a first column with the first plurality of products and a second column with the second plurality of products;

a dispensing path positioned about said product compartment so as to dispense the first plurality of products without heating;

a heating device positioned adjacent to said product compartment; and a positioning device positioned about said second column to maneuver the second plurality of products to said heating device and said dispensing path so as to dispense the second plurality of products as heated or not.

18. A vending machine for dispensing a first plurality of products and a second plurality of products, comprising:

a product compartment said product compartment comprising a first column with the first plurality of products end a second column with the second plurality of products;

a dispensing path positioned about said product compartment so as to dispense the first plurality of products without heating; and a modular dispensing kit;

said dispensing kit comprising a heating device positioned adjacent to said product compartment for heating the second plurality of products; and a positioning device positioned about said second column to maneuver the second plurality of products to said heating device and said dispensing path so as to dispense the second plurality of products.

19. A vending machine for dispensing a plurality of products comprising:

a product compartment with the plurality of products therein a conveyor belt positioned about said product compartment so as to transport the plurality of products;

a boating device positioned about said conveyor belt; and a pushing device to push said plurality of products into said heating device.

20. The vending machine of claim 19, further comprising a gully positioned adjacent to said conveyor belt and wherein said pushing device is positioned about said gully such that said plurality of products can be transported by said conveyor belt to said gully and pushed into said heating device by said pushing device.

* * * * *

UNITED STATES PATENT AND TRADEMARK OFFICE

CERTIFICATE OF CORRECTION

PATENT NO. : 6,808,083 B2 
APPLICATION NO. : 10/159521
DATED : October 26, 2004
INVENTOR(S) : Jurgen Roekens et al.

It is certified that error appears in the above-identified patent and that said Letters Patent is hereby corrected as shown below:

In Col. 8, Claim 3, line 4, please delete "fist" after "said" and before "column" and insert --first--.

In Col. 8, Claim 15, line 52, please delete "ma" after "so" and before "to" and insert --as--.

In Col. 8, Claim 16, line 62, please delete ")" and insert --.--.

In Col. 9, Claim 18, line 20, please replace the word "end" after "products and before "a" with --and--.

In Col. 10, Claim 19, line 12, please insert a --:-- after "therein".

In Col. 10, Claim 19, line 15, please delete "boating" after "a" and before "device" and insert --heating--.

Signed and Sealed this

Thirtieth Day of October, 2007

JON W. DUDAS
*Director of the United States Patent and Trademark Office*